US006140768A

United States Patent [19]

Kim

[11] Patent Number: 6,140,768

[45] Date of Patent: Oct. 31, 2000

[54] PLASMA DISPLAY PANEL HAVING REFLECTIVE PLATE WITH LIGHT SHIELDING WALLS

[75] Inventor: Hak-yong Kim, Seoul, Rep. of Korea

[73] Assignee: Samsung Electronics Co., Ltd., Kyungki, Rep. of Korea

[21] Appl. No.: 09/361,116

[22] Filed: Jul. 27, 1999

[30] Foreign Application Priority Data

Jul. 27, 1998 [KR] Rep. of Korea ..... 98-30211

[51] Int. Cl.[7] ..... H01J 17/49

[52] U.S. Cl. ..... 313/584; 313/587; 313/113; 313/116; 313/586; 345/60

[58] Field of Search ..... 313/581, 582, 313/113, 506, 509, 584; 345/60, 506, 509, 586, 587, 584, 116, 117

[56] References Cited

U.S. PATENT DOCUMENTS 4,803,402 2/1989 Raber et al. ..... 313/509
5,656,893 8/1997 Shino et al. ..... 313/313
5,804,918 9/1998 Yazawa et al. ..... 313/506
5,932,967 8/1999 Chikazawa ..... 313/582
6,004,686 12/1999 Rasmussen et al. ..... 313/506

*Primary Examiner*—Michael H. Day
*Assistant Examiner*—Mariceli Santiago
*Attorney, Agent, or Firm*—Sughrue, Mion, Zinn, Macpeak & Seas, PLLC

[57] ABSTRACT

A plasma display device including: a front substrate and a rear substrate assembled to face each other; partition walls equidistantly disposed between the front and rear substrates to define a plurality of discharge cells; phosphorous layers respectively formed on inner surfaces of discharge cells; groups of stripe-shaped electrodes formed on the front and rear substrates to be orthogonal with respect to each other; and a reflective plate installed at the back surface of the rear substrate.

4 Claims, 2 Drawing Sheets

PLASMA DISPLAY PANEL HAVING REFLECTIVE PLATE WITH LIGHT SHIELDING WALLS

BACKGROUND OF THE INVENTION

1. Field of the Invention

The present invention relates to a flat panel display device, and more particularly, to a plasma display panel which displays images using gas discharge.

2. Description of the Related Art

A plasma display panel is a display device in which a discharge gas is filled between electrodes installed in sealed spaces, and a predetermined voltage is applied to respective electrodes to create a glow discharge, and accordingly ultraviolet rays produced during the glow discharge excite a phosphorous layer to form an image. Since display characteristics of the plasma display panel, such as resolution, brightness, contrast and a field of view are excellent, the plasma display panel is anticipated to be a display device which can replace the existing cathode ray tube.

Such plasma display panels are classified into a direct current type and an alternating current type according to the discharge mechanism, i.e., the driving method. In the direct current type plasma display panel, electrodes are exposed to a discharge gas sealed in respective cells, and the voltage applied across the electrodes is applied across the discharge gas itself. On the other hand, in the alternating current type plasma display panel, since electrodes are isolated from the discharge gas by respective dielectric layers, the electrodes do not absorb charged particles produced during discharge, and instead wall charges are formed to cause a discharge.

Referring to FIGS. 1 and 2, in a conventional plasma display panel, a front substrate 100 made of a transparent material such as glass and a rear substrate 200 are assembled to face each other and form discharge spaces.

On the front substrate 100, stripe-shaped transparent electrodes 110 are equidistantly formed, and stripe-shaped bus electrodes 111 made of highly conductive electrode material, for example, chromium (Cr) or silver (Ag) are formed on one side end of the transparent electrodes 110, respectively to have a narrower width than that of the electrodes 110. Then, the transparent electrodes 110 and the bus electrodes 111 are embedded in a dielectric layer 120.

On the rear substrate 200, stripe-shaped address electrodes 210 are formed to be orthogonal with respect to the transparent electrodes 110 and the bus electrodes 111 of the front substrate 100, and also the address electrodes 210 are embedded in a dielectric layer 220. In addition, a plurality of partition walls 230 are formed on the dielectric layer 220 to define discharge cells 201, and in each discharge cell 201 a phosphorous layer 240 is continuously formed on side surfaces of the partition walls 230 and the bottom surface of the discharge cell 201.

In the conventional plasma display panel configured as above, since light rays emitted from the phosphorous layers 240 of the respective discharge cells 201 can pass through both the front substrate 100 and the rear substrate 200, the light rays emitted from the phosphorous layers 240 can not be effectively utilized, and therefore there is a problem that image brightness of the panel is low. Further, since external light rays L entering through the rear substrate 200 appear in front of the front substrate 100, there is another problem in which image contrast of the panel becomes low.

SUMMARY OF THE INVENTION

To solve the above problems, it is an objective of the present invention to provide a plasma display panel in which image brightness and contrast of the panel are enhanced by utilizing light rays emitted from a phosphorous material to a greater extent.

Accordingly, to achieve the above objective, there is provided a plasma display device including: a front substrate and a rear substrate assembled to oppose each other in a lateral direction; a plurality of partition walls equidistantly spaced with respect to each other and disposed between the front substrate and the rear substrate to define a plurality of discharge cells; phosphorous layers respectively formed on inner surfaces of the plurality of discharge cells; a plurality of stripe-shaped electrodes formed on an interior surface of the front substrate and an interior surface of the rear substrate with the strip-shaped electrodes formed on opposing surfaces orthogonal with respect to each other; and a reflective plate disposed on an outside surface of the rear substrate.

According to one aspect of the present invention, it is preferable that the reflective plate has a reflective surface substantially conjoined with the outside surface of the rear substrate, an opposing light-shielding surface, and internal light shielding walls disposed so as to have reflection areas corresponding to the respective discharge cells and is formed to be concave at the reflective surface thereof and to be convex at the light-shielding surface thereof.

According to another aspect of the present invention, the light shielding walls of the reflective plate may be formed in a stripe-shape, of a black material.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE PREFERRED EMBODIMENTS

Figure 1:
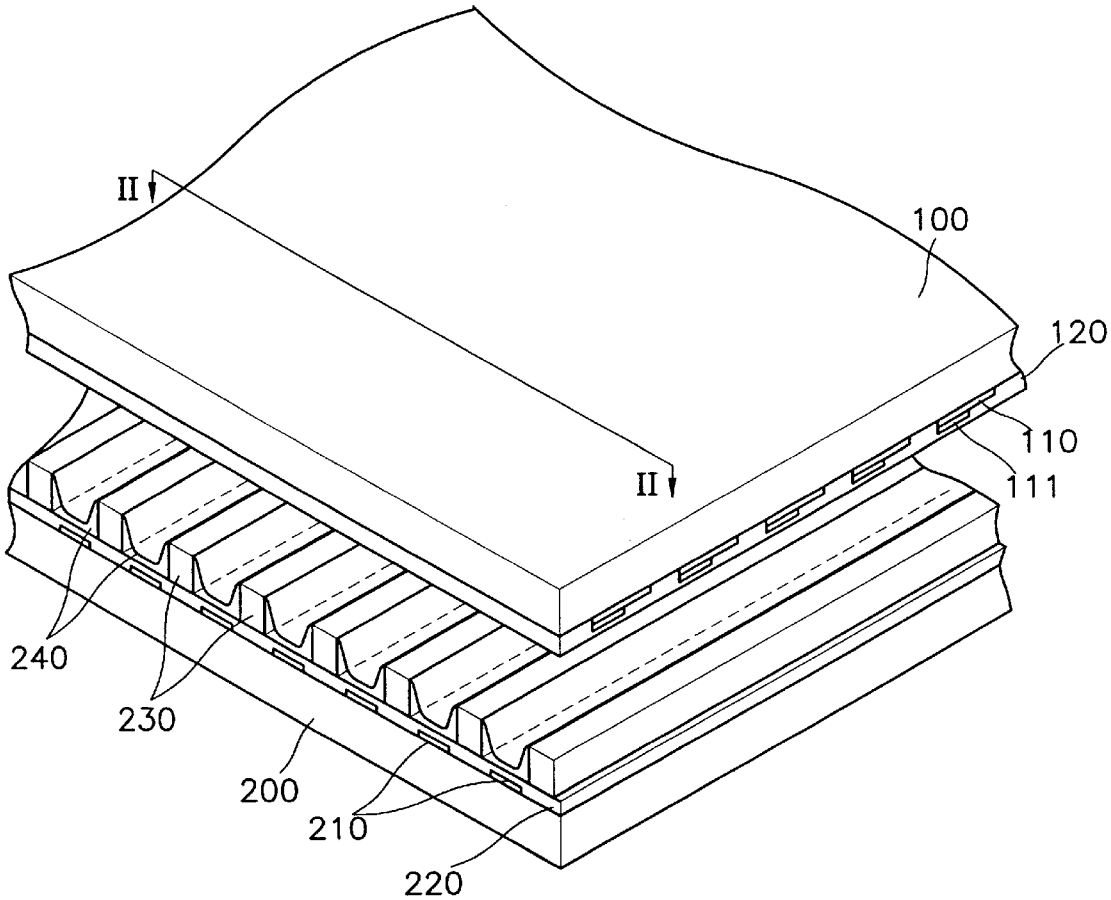
FIG. 1 (PRIOR ART)
FIG. 1 is a schematic exploded perspective view illustrating an essential portion of a conventional plasma display panel.
Figure 2:
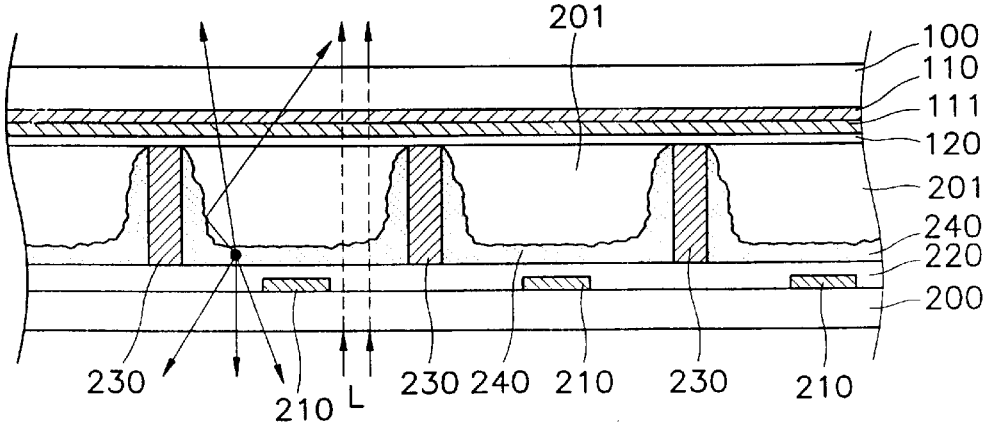
FIG. 2 (PRIOR ART)
FIG. 2 is a section view illustrating the portion of the conventional plasma display panel of FIG. 1 in an assembled state.
Figure 3:
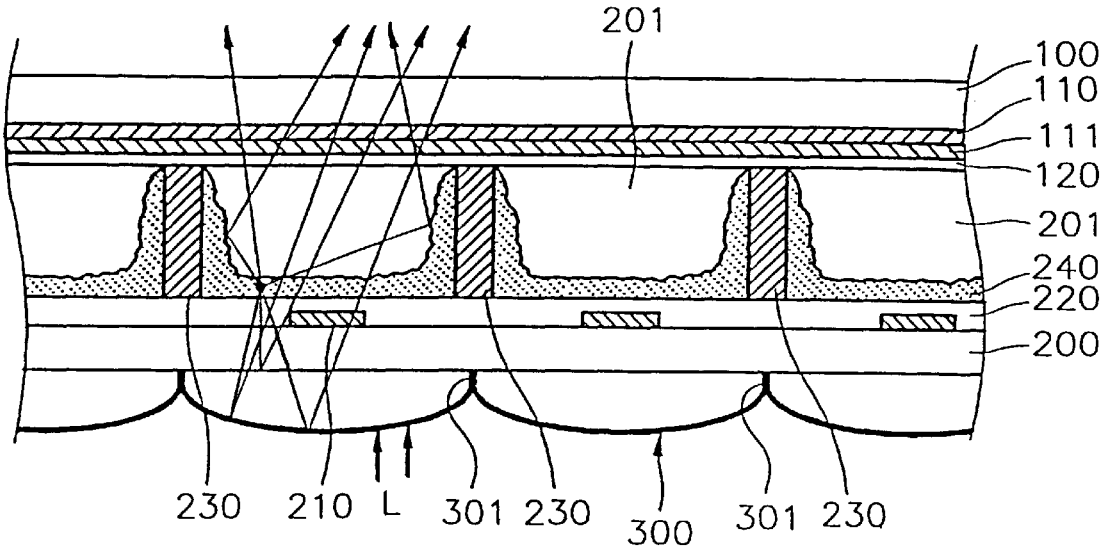
FIG. 3 is a section view illustrating an essential portion of an assembled plasma display panel according to one embodiment of the present invention.

Referring to FIG. 3, in a plasma display panel according to the present invention, a front substrate 100 and a rear substrate 200 which are made of a transparent material such as glass are assembled to face each other and form discharge spaces, as shown in FIG. 3, and a reflective plate 300 is provided on the back surface of the rear substrate 200.

On the front substrate 100, stripe-shaped transparent electrodes 110 are equidistantly formed, and stripe-shaped bus electrodes 111 having a narrower width than that of the electrodes 110 are formed on one side end of the transparent electrodes 110, respectively. Then, the transparent electrodes 110 and the bus electrodes 111 are embedded in a dielectric layer 120.

On the rear substrate 200, stripe-shaped address electrodes 210 are formed to be orthogonal with respect to the transparent electrodes 110 and the bus electrodes 111 of the front substrate 100, and also the address electrodes 210 are embedded in a dielectric layer 220. In addition, a plurality of partition walls 230 are formed on the dielectric layer 220 to define discharge cells 201, and in each discharge cell 201 a phosphorous layer 240 is continuously formed on side surfaces of the partition walls 230 and the bottom surface of the discharge cell 201.

The reflective plate 300 as a characteristic feature of a plasma display panel according to the present invention, reflects a portion of light rays traveling from the phosphorous layer 240 and the front substrate 100 to the rear substrate 200, and return the reflected portion toward the front substrate 100. In addition, the reflective plate 300 initially shields external light rays L traveling toward the rear substrate 200.

According to the present invention, the reflective plate 300 has light shielding walls 301 at positions corresponding to the partition walls 230 so as to have reflection areas corresponding to the respective discharge cells 201 as shown in FIG. 3. Also, the reflective plate 300 has light shielding walls (not shown) perpendicular to the light shielding walls 301 at positions corresponding to the middle linear portions between neighboring transparent electrodes 110 of the front substrate 100.

In addition, according to the present invention, the reflective plate 300 is formed to be concave at the reflective surface thereof and to be convex at the rear part thereof so as to enhance the efficiency of reflection. The reflective plate 300 may be, for example, a typical reflective mirror in which a reflective layer made of aluminum (Al) or silver (Ag) is formed on a transparent substrate.

Figure 4:
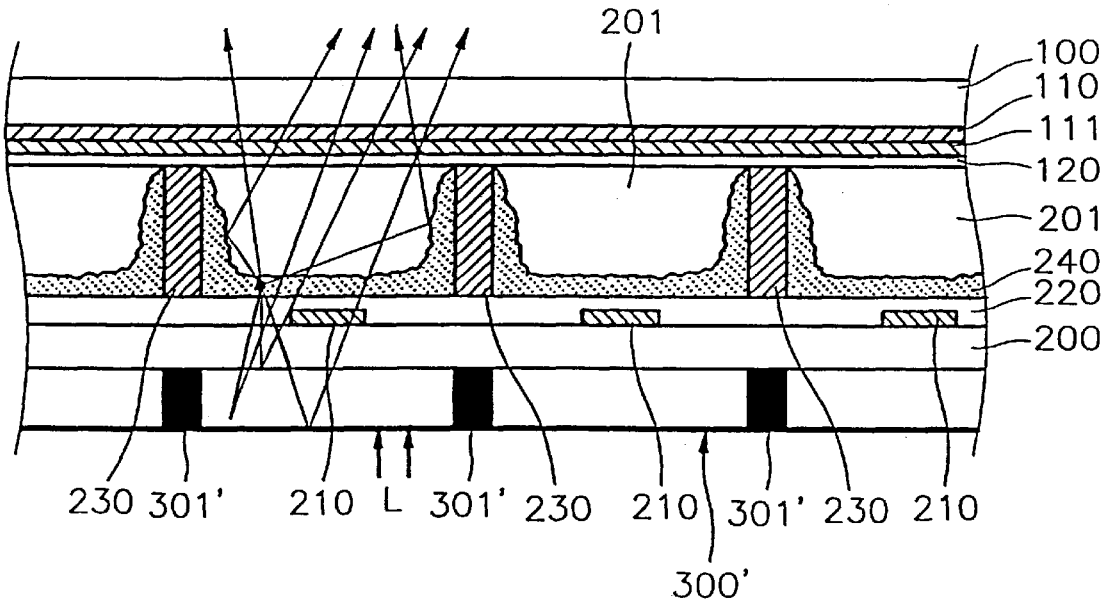
FIG. 4 is a section view illustrating an essential portion of an assembled plasma display panel according another embodiment of the present invention.

FIG. 4 is a section view illustrating an essential portion of a plasma display panel according another embodiment of the present invention, a reflective plate 300' is installed on the back surface of a rear substrate 200 and is provided with strips of black material 301' at positions corresponding to the partition walls 230 so as to have reflection areas corresponding to respective discharge cells 201.

Also in the case of the reflective plate 300', it is preferable that the reflective plate 300' is formed to be concave at the reflective surface thereof and to be convex at the rear part thereof so as to enhance the efficiency of reflection.

With the plasma display panel configured as above according to the present invention, light rays are emitted from the phosphorous layer 240 of the discharge cell 201. Since the light rays traveling toward the rear substrate 200 are reflected by the reflective plate 300 or 300', almost all light rays exit through the front substrate 100. Therefore, the light rays emitted from the phosphorous layer 240 are effectively utilized to a larger extent and image brightness can be enhanced.

Further, since the light shielding walls 301 of the reflective plate 300 or the strips of black material 300' prevent interference by light rays of neighboring cells, and the external light rays L are initially shielded by the reflective plate 300, image contrast can be enhanced as well.

As described above, according to the plasma display device of the present invention, since light rays emitted from a phosphorous layer are effectively utilized to a larger extent and image brightness can be enhanced, and in addition, since the influence of external light rays is minimized, image contrast can be enhanced.

While preferred embodiments of the invention have been described and illustrated herein, it will be apparent to those skilled in the art that variations and modifications are possible without deviating from the broad principles and teachings of the present invention which shall be limited solely by the scope of the claims appended hereto.

What is claimed is:

1. A plasma display device including:

a front substrate and a rear substrate assembled to face each other;

partition walls equidistantly disposed between the front and rear substrates to define a plurality of dischage cells;

phosphorous layers respectively formed on inner surfaces of discharge cells;

groups of stripe-shaped electrodes formed on the front and rear substrates to be orthogonal with respect to each other; and a reflective plate installed at the back surface of the rear substrate the reflective plate having light shielding walls so as to have reflection areas corresponding to the respective discharge cells.

2. The plasma display device as claimed in claim 1, wherein the reflective plate is formed to be concave at the reflective surface thereof.

3. The plasma display device as claimed in claim 1, wherein the reflective plate is provided with strips of black material in its interior so as to have reflection areas corresponding to the respective discharge cells.

4. The plasma display device as claimed in claim 1, wherein the reflective plate is provided with strips of black material in its interior so as to have reflection areas corresponding to the respective discharge cells and is formed to be concave at the reflective surface thereof.

* * * * *